US009800981B2

(12) United States Patent
Kuriger

(10) Patent No.: US 9,800,981 B2
(45) Date of Patent: Oct. 24, 2017

(54) HEARING DEVICE COMPRISING A DIRECTIONAL SYSTEM

(71) Applicant: Bernafon AG, Bern (CH)

(72) Inventor: Martin Kuriger, Bern (CH)

(73) Assignee: BERNAFON AG, Bern (CH)

( * ) Notice: Subject to any disclaimer, the term of this patent is extended or adjusted under 35 U.S.C. 154(b) by 6 days.

(21) Appl. No.: 14/845,871

(22) Filed: Sep. 4, 2015

(65) Prior Publication Data

US 2016/0073203 A1 Mar. 10, 2016

(30) Foreign Application Priority Data

Sep. 5, 2014 (EP) ..... 14183725

(51) Int. Cl.
*H04R 3/00* (2006.01)
*H04R 25/00* (2006.01)
*H04S 7/00* (2006.01)

(52) U.S. Cl.
CPC ..... *H04R 25/407* (2013.01); *H04R 3/005* (2013.01); *H04R 25/405* (2013.01); *H04R 25/43* (2013.01);
(Continued)

(58) Field of Classification Search
CPC ..... H04R 2430/20; H04R 2430/23; H04R 25/405; H04R 25/407; H04R 25/43; H04R 25/552; H04R 3/005; H04S 7/307
(Continued)

(56) References Cited

U.S. PATENT DOCUMENTS 6,766,029 B1 * 7/2004 Maisano ..... H04R 3/005 381/313
9,338,565 B2 * 5/2016 Hansen ..... G09B 21/04
(Continued)

FOREIGN PATENT DOCUMENTS

DE 19818611 C1 * 9/1999 ..... H04M 9/08
WO WO 95/29479 A1 9/2007
WO WO 2007/106399 A2 9/2007

OTHER PUBLICATIONS

Chau et al., "A Subband Beamformer on an Ultra Low-Power Miniature DSP Platform," IEEE International Conference on Acoustics, Speech, and Signal Processing (ICASSP), May 13, 2002, pp. 2953-2956.
(Continued)

*Primary Examiner* — Vivian Chin
*Assistant Examiner* — Friedrich W Fahnert
(74) *Attorney, Agent, or Firm* — Birch, Stewart, Kolasch & Birch, LLP

(57) ABSTRACT

The application relates to a hearing device comprising an input unit for providing first and second electric input signals representing sound signals, a beamformer filter for making frequency-dependent directional filtering of the electric input signals, the output of said beamformer filter providing a resulting beamformed output signal. The application further relates to a method of providing a directional signal. The object of the present application is to create a directional signal. The problem is solved in that the beamformer filter comprises a directional unit for providing respective first and second beamformed signals from weighted combinations of the electric input signals, an equalization unit for equalizing a phase (and possibly an amplitude) of the beamformed signals and providing first and second equalized beamformed signals, and a beamformer output unit for providing the resulting beamformed
(Continued)

output signal from the first and second equalized beamformed signals. This has the advantage to create a directional signal where the phase of the individual components is preserved, and therefore introducing no phase distortions. The invention may e.g. be used in hearing aids, headsets, ear phones, active ear protection systems, and combinations thereof.

17 Claims, 7 Drawing Sheets

(52) U.S. Cl.
CPC ..... *H04R 25/552* (2013.01); *H04S 7/307* (2013.01); *H04R 2430/20* (2013.01); *H04R 2430/23* (2013.01)

(58) Field of Classification Search
USPC ..... 381/71.6, 92, 100, 103, 120, 122, 303, 381/313, 316, 330
See application file for complete search history.

(56) References Cited

U.S. PATENT DOCUMENTS

2005/0175204 A1* 8/2005 Bock ..... H04R 25/407 381/330
2010/0158267 A1* 6/2010 Thormundsson ..... H04R 3/005 381/92
2011/0317041 A1* 12/2011 Zurek ..... H04R 1/406 348/240.99
2012/0057732 A1* 3/2012 Choi ..... H04S 7/303 381/303
2014/0270290 A1* 9/2014 Cheung ..... H04R 25/554 381/316
2015/0003623 A1* 1/2015 Rasmussen ..... G10K 11/002 381/71.6
2015/0124997 A1* 5/2015 Banba ..... H04R 1/406 381/92
2015/0249892 A1* 9/2015 Kuhnel ..... H04R 25/552 381/315
2015/0289065 A1* 10/2015 Jensen ..... H04R 25/552 381/315
2015/0341730 A1* 11/2015 Pedersen ..... H04R 25/407 381/322
2016/0173047 A1* 6/2016 Hui ..... H03G 3/301 381/100

OTHER PUBLICATIONS

Gooch, "Adaptive Pole-Zero Array Processing," Proc. 16th Asilomar Conf. Circuits Syst. Comput., Nov. 1983, pp. 45-49.
Griffiths et al., "An Alternative Approach to Linearly Constrained Adaptive Beamforming," IEEE Transactions on Antennas and Propagation, vol. AP-30, No. 1, Jan. 1982, pp. 27-34.
Joho et al., "On the Design of the Target-Signal Filter in Adaptive Beamforming," IEEE International Symposium on Circuits and Systems, vol. 5, 1998, pp. 166-169 (4 pages).

* cited by examiner

HEARING DEVICE COMPRISING A DIRECTIONAL SYSTEM

TECHNICAL FIELD

The present application relates to a hearing device, e.g. a hearing instrument, comprising a multitude of input transducers, each providing a representation of a sound field around the hearing device, and a directional algorithm to provide a directional signal by determining a specific combination of the various sound field representations. The disclosure relates specifically to the topic of minimizing phase distortion in a directional signal (e.g. fully or partially embodied in a procedure or algorithm), and in particular to a hearing device employing such procedure or algorithm.

The application furthermore relates to the use of a hearing device and to a method of creating a directional signal. The application further relates to a method of minimizing the phase distortion introduced by the directional system. The application further relates to a data processing system comprising a processor and program code means for causing the processor to perform at least some of the steps of the method.

Embodiments of the disclosure may e.g. be useful in applications such as hearing aids, headsets, ear phones, active ear protection systems, and combinations thereof.

BACKGROUND

The following account of the prior art relates to one of the areas of application of the present application, hearing aids.

The separation of wanted (target signal, S) and unwanted (noise signal, N) parts of a sound field is important in many audio applications, e.g. hearing aids, various communication devices, handsfree telephone systems (e.g. for use in a vehicle), public address systems, etc. Many techniques for reduction of noise in a mixed signal comprising target and noise are available. Focusing the spatial gain characteristics of a microphone or a multitude (array) of microphones in an attempt to enhance target signal components over noise signal components is one such technique, also referred to as beam forming or directionality. [Griffiths and Jim; 1981] describe a beamforming structure for implementing an adaptive (time-varying) directional characteristic for an array of microphones. [Gooch; 1982] deals with a compensation of the LF roll-off introduced by the target cancelling beamformer. [Joho and Moschytz; 1998] deals with a design strategy for the target signal filter in a Griffiths-Jim Beamformer. It is shown that by a proper choice of this filter, namely high-pass characteristics with an explicit zero at unity, the pole of the optimal filter vanishes, resulting in a smoother transfer function.

WO2007106399A2 deals with a directional microphone array having (at least) two microphones that generate forward and backward cardioid signals from two (e.g., omnidirectional) microphone signals. An adaptation factor is applied to the backward cardioid signal, and the resulting adjusted backward cardioid signal is subtracted from the forward cardioid signal to generate a (first-order) output audio signal corresponding to a beam pattern having no nulls for negative values of the adaptation factor. After low-pass filtering, spatial noise suppression can be applied to the output audio signal.

The present disclosure relates to an alternative scheme for implementing a beamformer.

SUMMARY

An object of the present application is to create a directional signal. A further object is to reduce phase distortion in a directional signal.

Objects of the application are achieved by the invention described in the accompanying claims and as described in the following.

A Hearing Device:

In an aspect, an object of the application is achieved by a hearing device comprising an input unit for providing first and second electric input signals representing sound signals, a beamformer filter for making frequency-dependent directional filtering of the electric input signals, the output of said beamformer filter providing a resulting beamformed output signal. The beamformer filter comprises a directional unit for providing respective first and second beamformed signals from weighted combinations of the electric input signals, an equalization unit for equalizing a phase of the beamformed signals and providing first and/or second equalized beamformed signals, and a beamformer output unit for providing the resulting beamformed output signal from the first and second (beamformed or) equalized beamformed signals.

This has the advantage of providing an alternative scheme for creating a directional signal.

The equalized beamformed signals are preferably compensated for phase differences imposed by the input unit and the directional unit. The equalized beamformed signals are preferably compensated for amplitude differences imposed by the input unit and/or the directional unit. The amplitude compensation may be fully or partially performed in the input unit and/or in the directional unit).

In an embodiment, the beamformer output unit is configured to provide the resulting beamformed output signal in accordance with a predefined rule or criterion. In an embodiment, the beamformer output unit is configured to optimize a property of the resulting beamformed output signal. In an embodiment, the beamformer output unit comprises an adaptive algorithm. In an embodiment, the beamformer output unit comprises an adaptive filter. Preferably, the beamformer output unit comprising the adaptive filter is located after the equalization unit (i.e. works on the equalized signal(s)). This has the advantage of improving the resulting beamformed signal.

In an embodiment, the predefined rule or criterion comprises minimizing the energy, amplitude or amplitude fluctuations of the resulting beamformed output signal. In an embodiment, the predefined rule or criterion comprises minimizing the signal from one specific direction. In an embodiment, the predefined rule or criterion comprises sweeping a zero of the angle dependent characteristics of the resulting beamformed output signal over predefined angles, such as over a predefined range of angles.

In an embodiment, the equalization unit is configured to compensate the transfer function difference (e.g. in amplitude and/or phase) between the first and second beamformed signals introduced by the input unit and the directional unit. An input signal in the frequency domain is generally assumed to be a complex number X(t,f) dependent on time t and frequency f: $X=Mag(X)*e^{i*Ph(X)}$, where 'Mag' is magnitude and 'Ph' denote phase. In an embodiment, the transfer function difference between the first and second beamformed signals introduced by the input unit depend on the configuration of the first and second electric input signals, e.g. the geometry of a microphone array (e.g. the distance between two microphones) creating the electric input signals. In an embodiment, the transfer function difference between the first and second beamformed signals introduced by the directional unit depend on the respective beamformer functions generated by the directional unit (e.g. enhanced omni-directional (e.g. a delay and sum beamformer), front cardoid, rear cardoid (e.g. a delay and subtract beamformer), etc.). In an embodiment, the transfer function difference between the first and second beamformed signals introduced by the input unit depend on possible non-idealities of the setup (e.g. microphone mismatches, or compensations for such mis-matches).

The term 'enhanced omni-directional' is in the present context taken to mean a delay and sum beamformer, which is substantially omni-directional at relatively low frequencies and slightly directional at relatively high frequencies. In an embodiment, the enhanced omni-directional signal is aimed at (having a maximum gain in direction of) a target signal at said relatively high frequencies (the direction to the target signal being e.g. determined by a look direction of the user wearing the hearing device in question).

Embodiments of the disclosure provide one or more of the following advantages:

- relatively simple implementation of the adaptive part (if it is adaptive),
- preservation of directional cues (with binaural hearing devices),
- provision of additional insight into the nature of the sound signal when comparing different instances of directional signals (sound field analysis, source localization).

In an embodiment, the first and/or second electric input signals represent omni-directional signals. In an embodiment, the first and second electric input signals ($I_1$, $I_2$) are omni-directional signals. In an embodiment, the hearing device comprises first and second input transducers providing the first and second electric input signals, respectively. In an embodiment, the first and second input transducers each have an omni-directional characteristic (having a gain, which is independent of the direction of incidence of a sound signal).

In an embodiment, the input unit is configured to provide more than two (the first and second) electric input signals representing sound signals, e.g. three, or more. In an embodiment, the input unit comprises an array of input transducers (e.g. a microphone array), each input transducer providing an electric input signals representing sound signals.

In an embodiment, the directional unit comprises first and second beamformers for generating the first and second beamformed signals, respectively.

In an embodiment, the first and second beamformers are configured as an omni-directional and a target-cancelling beamformer, respectively. In an embodiment, the first and second beamformed signals are an omni-directional signal and a directional signal with a maximum gain in a rear direction, respectively, a rear direction being defined relative to a target sound source, e.g. relative to the pointing direction of the input unit, e.g. a microphone array. 'A rear direction relative to a target sound source' (e.g. a pointing direction of the input unit) is in the present context taken to mean a direction 180° opposite the direction to the target source as seen from the user wearing the hearing device (e.g. 180° opposite the direction to the pointing direction of the microphone array). The second beamformer for generating the (second) beamformed signal with a maximum gain in a rear direction is also termed 'a target-cancelling beamformer'. In an embodiment, the beamformer filter comprises a delay unit for delaying the first electric input signal relative to the second electric input signal to generate a first delayed electric input signal. In an embodiment, the (second) beamformed signal with a maximum gain in a rear direction is created by subtracting the first delayed electric input signal from the second electric input signal.

In an embodiment, the omni-directional signal is en enhanced omni signal, e.g. created by adding two (aligned in phase and amplitude matched) substantially omni-directional signals. In an embodiment, the first beamformed signal is an enhanced omni-directional signal created by adding said first and second electric input signals. In an embodiment, the first beamformer is configured to generate the enhanced omni-directional signal. In an embodiment, no equalization of the enhanced omni-directional signal is performed by the equalization unit.

In an embodiment, the resulting beamformed output signal is a front cardioid signal created by subtracting said directional signal with a maximum gain in a rear direction from said omni-directional signal. In an embodiment, the resulting beamformed output signal is an omni-directional signal or a dipole, or a configuration there between (cf. e.g. FIG. 4).

In an embodiment, the hearing device comprises a TF-conversion unit for providing a time-frequency representation of a time-variant input signal. In an embodiment, the hearing device (e.g. the input unit) comprises a TF-conversion unit for each input signal. In an embodiment, each of the first and second electric input signals are provided in a time-frequency representation. In an embodiment, the time-frequency representation comprises an array or map of corresponding complex or real values of the signal in question in a particular time and frequency range. In an embodiment, the TF conversion unit comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the frequency domain, e.g. a DFT-unit (DFT=Discrete Fourier Transform), such as a FFT-unit (FFT=Fast Fourier Transform). A given time-frequency unit (m,k) may correspond to one DFT-bin and comprise a complex value of the signal X(m,k) in question ($X(m,k)=|X|\cdot e^{i\Phi}$, $|X|$=magnitude and $\phi$=phase) in a given time frame m and frequency band k. In an embodiment, the frequency range considered by the hearing device from a minimum frequency $f_{min}$ to a maximum frequency $f_{max}$ comprises a part of the typical human audible frequency range from 20 Hz to 20 kHz, e.g. a part of the range from 20 Hz to 12 kHz.

In an embodiment, the input unit provides more than two electric input signals, e.g. three or more. In an embodiment, at least one of the electric input signals originates from another (spatially separate) device, e.g. from a contra-lateral hearing device of a binaural hearing assistance system. In an embodiment, the input unit provides exactly two electric input signals. In an embodiment, both (or at least two) of the electric input signals originate from the hearing device in question (i.e. each signal is picked up by an input transducer located in the hearing device, or at least at or in one and the same ear of a user).

In an embodiment, the input unit comprises first and second input transducers for converting an input sound to the respective first and second electric input signals. In an embodiment, the first and second input transducers comprise first and second microphones, respectively.

In an embodiment, the input unit is configured to provide the electric input signals in a normalized form. In an embodiment, the input signals are provided at a variety of voltage levels, and the input unit is configured to normalize the variety of voltage levels and/or to compensate for different input transducer characteristics (e.g. microphone matching) and/or different physical locations of input transducers, allowing the different electric input signals to be readily compared. In an embodiment, the input unit comprises a normalization (or microphone matching) unit for matching said first and second microphones (e.g. towards a front direction).

In an embodiment, the hearing device is configured to determine, a target signal direction and/or location relative to the hearing device. In an embodiment, the hearing device is configured to determine a direction to a target signal source from the current orientation of the hearing device, e.g. to be a look direction (or a direction of a user's nose) when the hearing device is operationally mounted on the user (cf. e.g. FIGS. 6A-6B). In an embodiment, the hearing device (e.g. the beamformer filter) is configured to dynamically determine a direction to and/or location of a target signal source. Alternatively, the hearing device may be configured to use (assume) a fixed direction to the target signal source (e.g. equal to a front direction relative to the user, e.g. 'following the nose of the user', e.g. as indicated by a direction defined by a line through the geometrical centers of two microphones located on the housing of the hearing device, e.g. a BTE-part of a hearing aid, cf. FIGS. 6A-6B).

In an embodiment, the hearing device is configured to receive information (e.g. from an external device) about a target signal direction and/or location relative to the hearing device. In an embodiment, the hearing device comprises a user interface. In an embodiment, the hearing device is configured to receive information about a direction to and/or location of a target signal source from the user interface. In an embodiment, the hearing device is configured to receive information about a direction to and/or location of a target signal source from another device, e.g. a remote control device or a cellular telephone (e.g. a SmartPhone), cf. e.g. FIG. 5.

In an embodiment, the hearing device is adapted to provide a frequency dependent gain and/or a level dependent compression and/or a transposition (with or without frequency compression) of one or frequency ranges to one or more other frequency ranges, e.g. to compensate for a hearing impairment of a user. In an embodiment, the hearing device comprises a signal processing unit for enhancing the input signals and providing a processed output signal. Various aspects of digital hearing aids are described in [Schaub; 2008].

In an embodiment, the hearing device comprises an output unit for providing a stimulus perceived by the user as an acoustic signal based on a processed electric signal. In an embodiment, the output unit comprises a number of electrodes of a cochlear implant or a vibrator of a bone conducting hearing device. In an embodiment, the output unit comprises an output transducer. In an embodiment, the output transducer comprises a receiver (loudspeaker) for providing the stimulus as an acoustic signal to the user. In an embodiment, the output transducer comprises a vibrator for providing the stimulus as mechanical vibration of a skull bone to the user (e.g. in a bone-attached or bone-anchored hearing device).

The hearing device comprises a directional microphone system aimed at enhancing a target acoustic source among a multitude of acoustic sources in the local environment of the user wearing the hearing device. In an embodiment, the directional system is adapted to detect (such as adaptively detect) from which direction a particular part of the microphone signal originates. This can be achieved in various different ways as e.g. described in the prior art. In an embodiment, the hearing device comprises a microphone matching unit for matching the different (e.g. the first and second) microphones.

In an embodiment, the hearing device comprises an antenna and transceiver circuitry for wirelessly receiving a direct electric input signal from another device, e.g. a communication device or another hearing device.

In an embodiment, the hearing device is a relatively small device. The term 'a relatively small device' is in the present context taken to mean a device whose maximum physical dimension (and thus of an antenna for providing a wireless interface to the device) is smaller than 10 cm, such as smaller than 5 cm. In an embodiment, the hearing device has a maximum outer dimension of the order of 0.08 m (e.g. a head set). In an embodiment, the hearing device has a maximum outer dimension of the order of 0.04 m (e.g. a hearing instrument).

In an embodiment, the hearing device is a portable device, e.g. a device comprising a local energy source, e.g. a battery, e.g. a rechargeable battery.

In an embodiment, the hearing device comprises a forward or signal path between an input transducer (microphone system and/or direct electric input (e.g. a wireless receiver)) and an output transducer. In an embodiment, the signal processing unit is located in the forward path. In an embodiment, the signal processing unit is adapted to provide a frequency dependent gain according to a user's particular needs. In an embodiment, the hearing device comprises an analysis path comprising functional components for analyzing the input signal (e.g. determining a level, a modulation, a type of signal, an acoustic feedback estimate, etc.). In an embodiment, some or all signal processing of the analysis path and/or the signal path is conducted in the frequency domain. In an embodiment, some or all signal processing of the analysis path and/or the signal path is conducted in the time domain.

In an embodiment, the hearing device comprises an analogue-to-digital (AD) converter to digitize an analogue input with a predefined sampling rate, e.g. 20 kHz. In an embodiment, the hearing devices comprise a digital-to-analogue (DA) converter to convert a digital signal to an analogue output signal, e.g. for being presented to a user via an output transducer. Thereby, processing of the hearing device in the digital domain is facilitated. Alternatively, a part or all of the processing of the hearing device may be performed in the analogue domain.

In an embodiment, the hearing device comprises an acoustic (and/or mechanical) feedback suppression system. In an embodiment, the hearing device further comprises other relevant functionality for the application in question, e.g. compression, noise reduction, etc.

In an embodiment, the hearing device comprises a hearing aid, e.g. a hearing instrument (e.g. a hearing instrument adapted for being located at the ear or fully or partially in the ear canal of a user or fully or partially implanted in the head of a user), or a headset, an earphone, an ear protection device or a combination thereof.

Use:

In an aspect, use of a hearing device as described above, in the 'detailed description of embodiments' and in the claims, is moreover provided. In an embodiment, use is provided in a system comprising one or more hearing instruments, headsets, ear phones, active ear protection systems, etc., e.g. in handsfree telephone systems, teleconferencing systems, public address systems, karaoke systems, classroom amplification systems, etc.

A Hearing Assistance System:

In a further aspect, a listening system comprising a hearing device as described above, in the 'detailed description of embodiments', and in the claims, AND an auxiliary device is moreover provided.

In an embodiment, the system is adapted to establish a communication link between the hearing device and the auxiliary device to provide that information (e.g. control and status signals, possibly audio signals) can be exchanged or forwarded from one to the other.

In an embodiment, the auxiliary device is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the hearing device.

In an embodiment, the auxiliary device is or comprises a remote control for controlling functionality and operation of the hearing device(s).

In an embodiment, the auxiliary device is or comprises a cellular telephone, e.g. a SmartPhone. In an embodiment, the function of a remote control is implemented in a SmartPhone, the SmartPhone possibly running an APP allowing to control the functionality of the audio processing device via the SmartPhone (the hearing device(s) comprising an appropriate wireless interface to the SmartPhone, e.g. based on Bluetooth or some other standardized or proprietary scheme).

In an embodiment, the auxiliary device is or comprises another hearing device. In an embodiment, the hearing assistance system comprises two hearing devices adapted to implement a binaural hearing assistance system, e.g. a binaural hearing aid system. In an embodiment, the binaural hearing aid system comprises two independent binaural hearing devices, configured to preserve directional cues, the preservation of directional cues being enabled because each hearing device preserves the phase of the individual sound components.

In an embodiment, the binaural hearing aid system comprises two hearing devices configured to communicate with each other to synchronize the adaptation algorithm.

A Method:

In an aspect, a method of operating a hearing device comprising first and input transducers for converting an input sound to respective first and second electric input signals, a beamformer filter for making frequency-dependent directional filtering of the electric input signals, the output of said beamformer filter providing a resulting beamformed output signal is furthermore provided by the present application. The method comprises

- providing respective first and second beamformed signals from weighted combinations of said electric input signals;
- equalizing a phase of (at least one of) said beamformed signals and providing first and second equalized beamformed signals;
- providing the resulting beamformed output signal (RBFS) from the first and second (beamformed or) equalized beamformed signals.

Preferably, the first and second beamformed signals are

- an omni-directional signal and
- a directional signal with a maximum gain in a rear direction, a rear direction being defined relative to a target sound source.

In an embodiment, the omni-directional signal is an enhanced (target aiming) omni-directional signal.

In an embodiment, the directional signal with a maximum gain in a rear direction is a target cancelling beamformer signal.

Embodiments of the method may have the advantage of creating a directional signal without affecting the phase of the individual sound components.

It is intended that some or all of the structural features of the device described above, in the 'detailed description of embodiments' or in the claims can be combined with embodiments of the method, when appropriately substituted by a corresponding process and vice versa. Embodiments of the method have the same advantages as the corresponding devices.

In an embodiment, several instances of the algorithm that are configured to optimize a different property of the signal, resulting in several instances of the directional signal that can be compared and from which additional information about the sound field can be retrieved. In other words, a method according to the disclosure may be executed in parallel, each one having a different optimization goal. By comparing the output signals information about the present sound field can be revealed.

In an embodiment, several instances of the directional signal (e.g. having been subject to an optimization of the same property or different properties of the signal) that are fed to another signal processing algorithm (e.g. noise suppression, compression, feedback canceller) in order to provide information about the sound field, e.g. about the estimated target and noise signals. In other words, a method according to the disclosure may be executed in parallel, each one having a different optimization goal (e.g. one signal with a null in the back, one signal with a null on the side). These signals can provide additional information about the sound field to the noise suppression or other algorithms.

In an embodiment, a signal that is created based on several instances of the directional signal, containing information about the sound field, and sent to an external device indicating e.g. the location of target and noise sources. (the signals from the two hearing aids could also be combined in the external device). In other words, a method according to the disclosure may be executed in parallel, each one having a different optimization goal. The signals are then combined to reveal information about the sound field. In an embodiment, resulting directional signals from both hearing aids are combined.

A Computer Readable Medium:

In an aspect, a tangible computer-readable medium storing a computer program comprising program code means for causing a data processing system to perform at least some (such as a majority or all) of the steps of the method described above, in the 'detailed description of embodiments' and in the claims, when said computer program is executed on the data processing system is furthermore provided by the present application. In addition to being stored on a tangible medium such as diskettes, CD-ROM-, DVD-, or hard disk media, or any other machine readable medium, and used when read directly from such tangible media, the computer program can also be transmitted via a transmission medium such as a wired or wireless link or a network, e.g. the Internet, and loaded into a data processing system for being executed at a location different from that of the tangible medium.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application.

Further objects of the application are achieved by the embodiments defined in the dependent claims and in the detailed description of the invention.

As used herein, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element or intervening elements may be present, unless expressly stated otherwise. Furthermore, "connected" or "coupled" as used herein may include wirelessly connected or coupled. As used herein, the term "and/or" includes any and all combinations of one or more of the associated listed items. The steps of any method disclosed herein do not have to be performed in the exact order disclosed, unless expressly stated otherwise.

BRIEF DESCRIPTION OF DRAWINGS

The disclosure will be explained more fully below in connection with a preferred embodiment and with reference to the drawings in which.

The figures are schematic and simplified for clarity, and they just show details which are essential to the understanding of the disclosure, while other details are left out. Throughout, the same reference signs are used for identical or corresponding parts.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

Figure 1A:
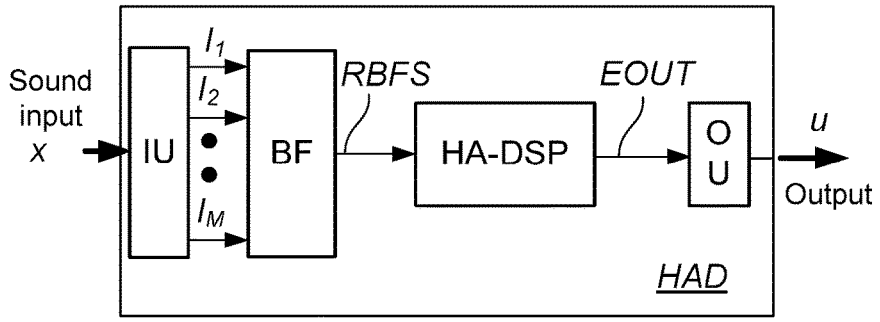
FIG. 1 shows three embodiments (FIG. 1A, 1B, 1C) of a hearing device according to the present disclosure.
Figure 1B:
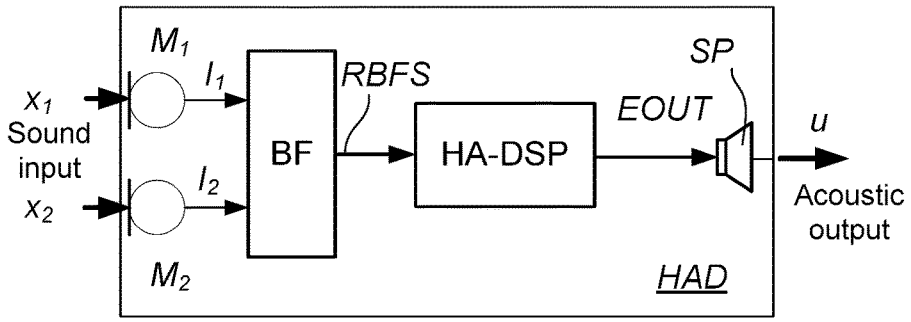
Figure 1C:
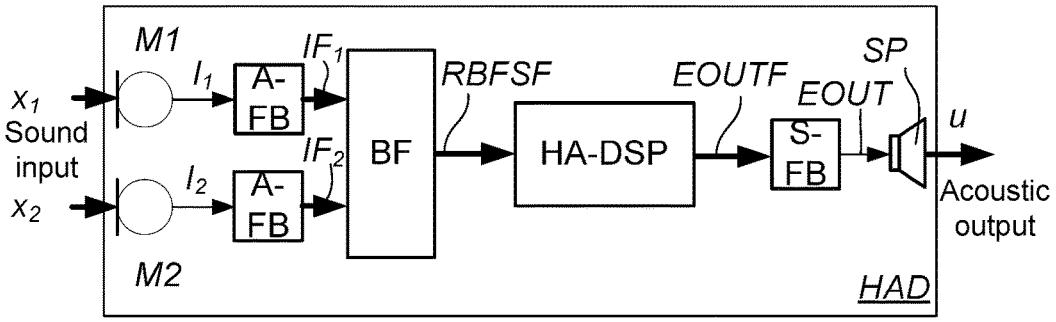

FIG. 1 shows three embodiments (FIG. 1A, 1B, 1C) of a hearing device according to the present disclosure. The hearing device (HAD), e.g. a hearing aid, comprises a forward or signal path from an input unit (IU; (M1, M2)) to an output unit (OU; SP), the forward path comprising a beamformer filter (BF) and a processing unit (HA-DSP). The input unit (IU in FIG. 1A) may comprise an input transducer, e.g. a microphone unit (such as M1, M2 in FIG. 1B, 1C, preferably having an omni-directional gain characteristic), and/or a receiver of an audio signal, e.g. a wireless receiver. The output unit (OU in FIG. 1A) may comprise an output transducer, e.g. a receiver or loudspeaker (such as SP in FIG. 1B, 1C) for converting an electric signal to an acoustic signal, and/or a transmitter (e.g. a wireless transmitter) for forwarding the resulting signal to another device for further analysis and/or presentation. The output unit may alternatively (or additionally) comprise a vibrator of a bone anchored hearing aid and/or a multi-electrode stimulation arrangement of a cochlear implant type hearing aid for providing a mechanical vibration of bony tissue and electrical stimulation of the cochlear nerve, respectively.

In the embodiment of FIG. 1A, the input unit (IU) picks up or receives a signal constituted by or representative of an acoustic signal from the environment (Sound input x) of the hearing device and converts (or propagates) it to a number of electric input signals ($I_1$, $I_2$, . . . , $I_M$, where M is the number of input signals, e.g. two or more). In an embodiment, the input unit comprises a microphone array comprising a multitude of microphones (e.g. more than two). The beamformer filter (BF) is configured for making frequency-dependent directional filtering of the electric input signals ($I_1$, $I_2$, . . . , $I_M$). The output of the beamformer filter (BF) is a resulting beamformed output signal (RBFS), e.g. being optimized to comprise a relatively large (target) signal (S) component and a relatively small noise (N) component (e.g. to have a relatively large gain in a direction of the target signal and to comprise a minimum of noise). The (optional) processing unit (HA-DSP) is configured to process the beamformed signal (RBFS) (or a signal derived therefrom) and to provide an enhanced output signal (EOUT). In an embodiment, wherein the hearing device comprises a hearing instrument, the processing unit (HA-DSP) is configured to apply a frequency dependent gain to the input signal (here RBFS), e.g. to adjust the input signal to the impaired hearing of a user. The output unit (OU) is configured to propagate or convert enhanced output signal (EOUT) to an output stimulus u perceptible by the user as sound (preferably representative of the acoustic input signal).

The embodiment of a hearing device of FIG. 1B is similar to the embodiment of FIG. 1A. The only difference is that the input unit (IU) is embodied in first and second (preferably matched) microphones (M1, M2) for converting each their versions of an input sound ($x_1$, $x_2$) present at their respective locations to respective first and second electric input signals ($I_1$, $I_2$), whereas the output unit (OU) is embodied in a loudspeaker (SP) providing acoustic output u.

The embodiment of a hearing device of FIG. 1C is similar to the embodiment of FIG. 1B. The only difference is that each of the microphone paths of the hearing device of FIG. 1C comprises an analysis filter bank (A-FB) for converting a time variant input signal to a number of time-frequency signals (as indicated by the bold line out of analysis filter bank (A-FB)), wherein the time domain signals ($I_1$, $I_2$) are represented in the frequency domain as time variant signals ($IF_1$, $IF_2$) in a number of frequency bands (e.g. 16 bands). In the embodiment of FIG. 1C, the further signal processing is assumed to be performed in the frequency domain (cf. beamformer filter (BF) and signal processing unit (HA-DSP) and corresponding output signals RBFSF and EOUTF, respectively (bold lines)). The hearing device of FIG. 1C further comprises a synthesis filter bank (S-FB) for converting the time-frequency signals EOUTF to time variant output signal EOUT which is fed to speaker (SP) and converted to an acoustic output sound signal (Acoustic output u).

Apart from the mentioned features, the hearing device of FIG. 1 may further comprise other functionality, such as a feedback estimation and/or cancellation system (for reducing or cancelling acoustic or mechanical feedback leaked via an 'external' feedback path from output to input transducer of the hearing device). Typically, the signal processing is performed on digital signals. In such case the hearing device comprises appropriate analogue-to-digital (AD) and possibly digital-to-analogue (DA) converters (e.g. forming part of the input and possibly output units (e.g. transducers)). Alternatively, the signal processing (or a part thereof) is performed in the analogue domain. The forward path of the hearing device comprises (optional) signal processing ('HA-DSP' in FIG. 1) e.g. adapted to adjust the signal to the impaired hearing of a user.

FIGS. 2A, 2B, 2C and 2D show four embodiments of a hearing device according to the present disclosure comprising two or more audio inputs and a beamformer filter.

Figure 2A:
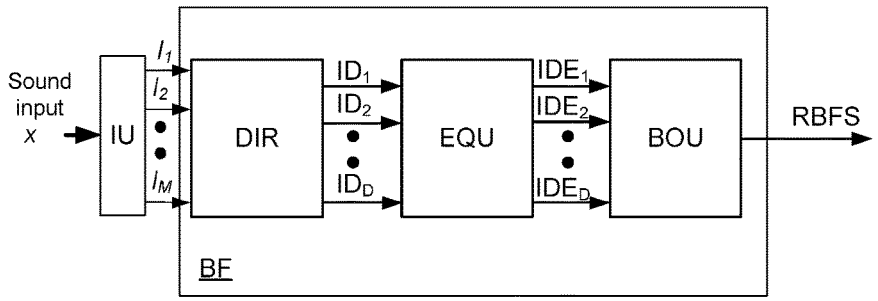
FIG. 2 shows four embodiments (FIG. 2A, 2B, 2C, 2D) of a hearing device according to the present disclosure comprising two or more audio inputs and a beamformer filter.
Figure 2B:
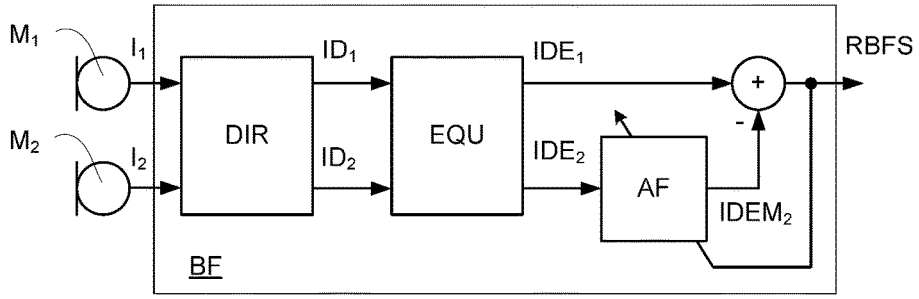
Figure 2C:
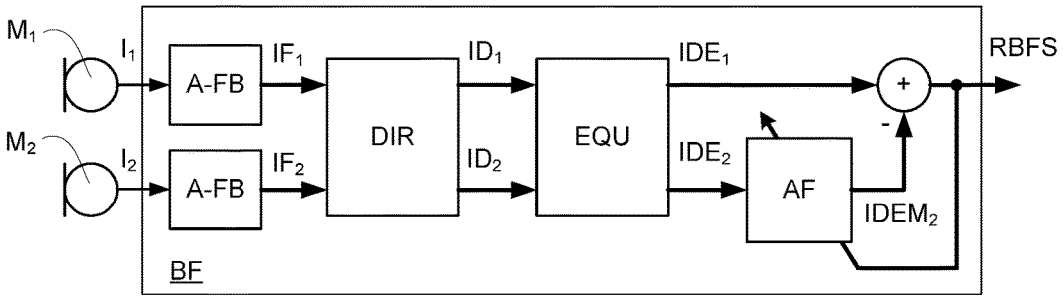

FIGS. 2A, 2B, and 2C may represent more specific embodiments of the hearing devices illustrated in FIGS. 1A, 1B and 1C, respectively.

FIG. 2A illustrates an embodiment, wherein (as in FIG. 1A) the input unit (IU) provides a multitude of electric input signals ($I_1$, $I_2$, . . . , $I_M$), which are fed to the beamformer filter (BF, solid enclosure). The beamformer filter (BF) comprises a directional unit (DIR) for providing respective beamformed signals ($ID_1$, $ID_2$, . . . , $ID_D$, where D is the number of beamformers, D≥2), from weighted combinations of the electric input signals ($I_1$, $I_2$, . . . , $I_M$). The beamformer filter (BF) further comprises an equalization unit (EQU) for equalizing a phase of the beamformed signals ($ID_1$, $ID_2$, . . . , $ID_D$) and providing respective equalized beamformed signals ($IDE_1$, $IDE_2$, . . . , $IDE_D$). The beamformer filter (BF) comprises a beamformer output unit (BOU) for providing the resulting beamformed output signal (RBFS) from the equalized beamformed signals ($IDE_1$, $IDE_2$, . . . , $IDE_D$).

FIGS. 2B and 2C illustrate embodiments of a hearing device, wherein (as in FIGS. 1B and 1C, respectively) the input unit (IU) is embodied in first and second (preferably matched) microphones (M1, M2) providing first and second electric input signals ($I_1$, $I_2$); $IF_1$, $IF_2$). The beamformer filter (BF) comprises a directional unit (DIR) for providing respective first and second beamformed signals ($ID_1$, $ID_2$) from weighted combinations of electric input signals ($I_1$, $I_2$); $IF_1$, $IF_2$), e.g. an omni-directional signal and a directional signal or two directional signals of different direction. The beamformer filter (BF) further comprises an equalization unit (EQU) for equalizing phase (incl. group delay, and optionally amplitude) of the beamformed signals ($ID_1$, $ID_2$) and providing first and second equalized beamformed signals ($IDE_1$, $IDE_2$). An example of an equalization unit is described in connection with FIG. 3. The beamformer filter further comprises a beamformer output unit (BOU), here comprising an adaptive filter (AF) for filtering the second equalized beamformed signal ($IDE_2$) and providing a modified second equalized beamformed signal ($IDEM_2$), and a subtraction unit ('+') for subtracting the modified second equalized beamformed signal ($IDEM_2$) from the first equalized beamformed signal ($IDE_1$) thereby providing a resulting beamformed output signal (RBFS). The adaptive filter (AF) is e.g. configured to optimize (e.g. minimize the energy of) the resulting beamformed output signal (RBFS).

The embodiment of a hearing device of FIG. 2C is identical to the embodiment of FIG. 2B apart from the processing being performed in the (time-)frequency domain in FIG. 2C. Each of the microphone paths of FIG. 2C comprises an analysis filter bank (A-FB) for converting time domain signals ($I_1$, $I_2$) to frequency domain signals ($IF_1$, $IF_2$) as indicated by bold lines in FIG. 2C. The resulting beamformed output signal (RBFS) is indicated in FIG. 2C to be a (time-)frequency domain signal. The signal may be converted to the time domain by a synthesis filter bank and may be further processed before (as indicated in FIG. 1C) or after being converted to the time domain.

Figure 2D:
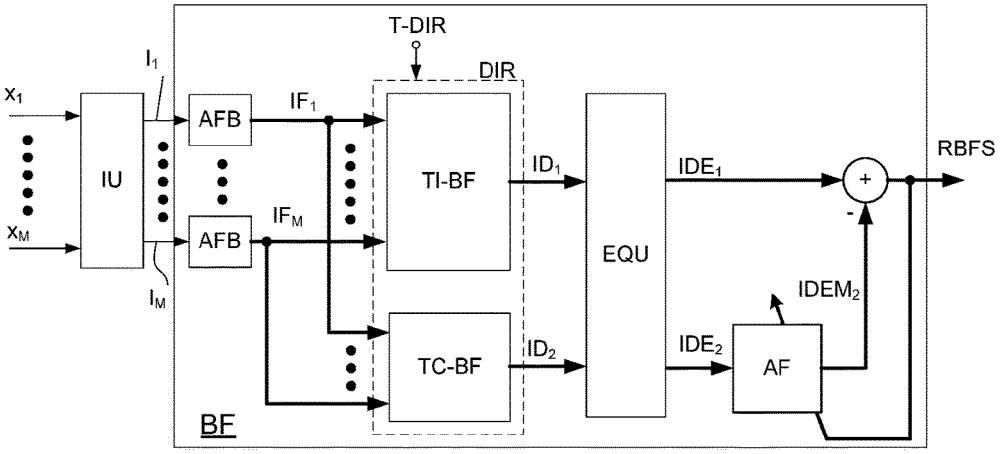

FIG. 2D shows an embodiment of a hearing device according to the present disclosure comprising two or more (here M) audio inputs and a beamformer filter (BF), wherein the beamformer filter comprises a directional filter unit (DIR) providing first and second beamformed (frequency domain) signals ($ID_1$, $ID_2$) from weighted combinations of electric (frequency domain) input signals ($IF_1$, . . . , $IF_M$). The directional filter unit (DIR) is configured to determine, or (as indicated in FIG. 2D) to receive an input indicative of (T-DIR), the direction to or location of the target signal (such direction may be assumed to be fixed, e.g. as a front direction relative to the user, or be configurable via a user interface, see e.g. FIG. 5). The directional filter unit (DIR) comprises first (TI-BF) and second (TC-BF) beamformers for generating the first and second beamformed signals ($ID_1$, $ID_2$), respectively. The first beamformer (TI-BF) of the embodiment of FIG. 2D is a target including beamformer configured to attenuate or apply gain to signals from all directions substantially equally (providing signal $ID_1$). The second beamformer (TC-BF) is a target cancelling beamformer configured to attenuate (preferably cancel) signals from the direction of the target signal (providing signal $ID_2$). The other parts of the embodiment of FIG. 2D resembles those of the embodiment of FIG. 2C(B). In an embodiment, the target including beamformer comprises an enhanced omni-directional beamformer.

Figure 3A:
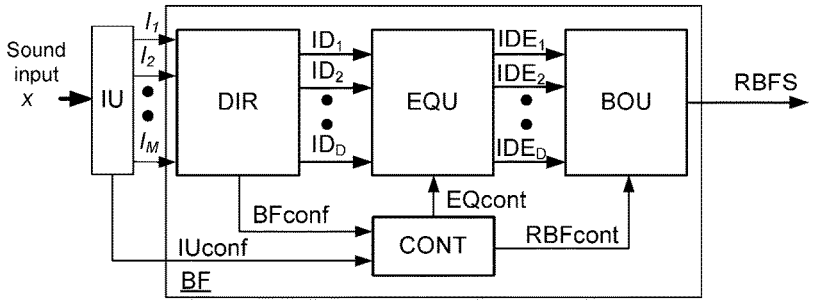
FIG. 3 shows two embodiments (FIG. 3A, 3B) of a hearing device comprising first and second input transducers and a beamformer filter according to the present disclosure.
Figure 3B:
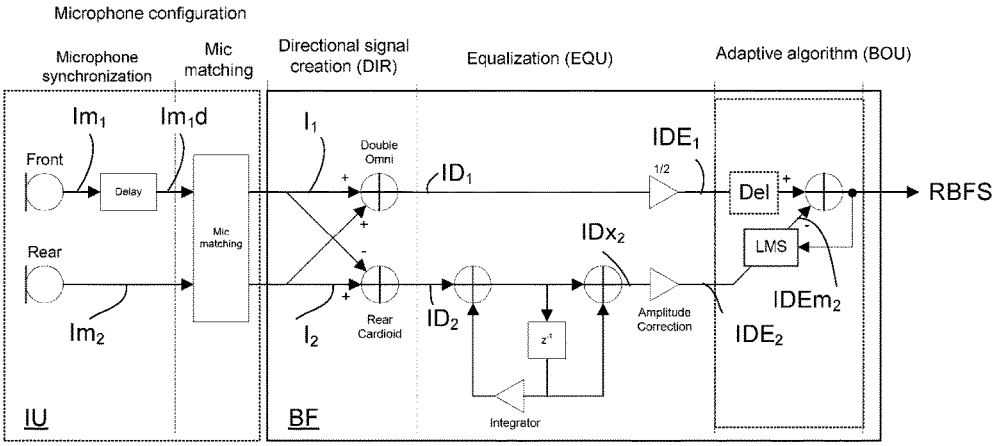

FIG. 3 shows two embodiments (FIG. 3A, 3B) of a hearing device comprising first and second input transducers and a beamformer filter according to the present disclosure.

FIG. 3A shows an embodiment as in FIG. 2A. Additionally, the embodiment of FIG. 3A comprises a control unit (CONT) for controlling the equalization unit (EQU).

The aim of the equalization unit (EQU) is to remove the phase difference between the beamformed signals ($ID_1$, $ID_2$, . . . , $ID_D$) (possibly) introduced by the input unit (IU) and/or the directional unit (DIR) (e.g. by determining an inverse transfer function and apply it to the relevant signals to equalize the phases of the beamformed signals, cf. e.g. FIG. 3B). An aim of the 'cleaning' of the introduced phase changes is further to simplify the interpretation of the different beamformed signals and hence to improve their use in to provide the resulting beamformed signal.

Phase differences (generally frequency dependent) may e.g. be introduced in the beamformed signals depending on the geometric configuration of the input transducers, e.g. the distance between two microphones, or the mutual position of units of a microphone array. Likewise, phase differences may e.g. be introduced in the beamformed signals due to mismatched input transducers (i.e. input transducers having different gain characteristics, e.g. having non-ideal (and different) omni-directional characteristics). The geometrical influence on phase differences is typically stationary (e.g. determined by fixed locations of microphones on a hearing device) and may be determined in advance of the use of the hearing device. Likewise, phase differences may e.g. be introduced in the beamformed signals due to sound field modifying effects, e.g. shadowing effects, e.g. from the user, e.g. an ear or a hat located close to the input unit of the hearing device and modifying the impinging sound field. Such sound field modifying effects are typically dynamic, in the sense that they are not predictable and have to be estimated during use of the hearing device. In FIG. 3A such 'information related to the configuration of the input unit is provided to the control unit (CONT) by signal IUconf.

Another possible source of introduction of phase differences in the beamformed signals are the individual beamformers (providing respective beamformed signals $ID_n$) of the directional unit (DIR). Different beamformers may introduce different (frequency dependent) phase 'distortions' (leading to introduction of phase differences between the beamformed signals ($ID_1$, $ID_2$, . . . , $ID_D$). Examples of different beamformers (formed as (possibly complex) weighting of the input signals) are Omni-directional,
Enhanced omni-directional,
Front cardioid (target aiming),
Rear cardioid (target cancelling)
Dipole.

Equalization of the mentioned (unintentionally introduced) phase differences may be performed as exemplified in the following. In general, if two microphones have a distance that result in a time delay d (where d has the unit of samples and is used to synchronize the microphones for signals from the look direction), the enhanced omni ($ID_1$) signal is calculated as $I_2+I_1$, (where $I1=Im_1*z^{-d}$). The rear cardioid ($ID_2$) signal is calculated as $I_2-I_1$, (where $I1=Im_1*z^{-d}$). So the transfer function difference of $ID_2$ relative to $ID_1$ is: $(1-z^{-d})/(1+z^{-d})$. It is assumed, that the two input signals $I_1$ and $I_2$ are perfectly amplitude-matched for signals coming from the front (by the Mic matching block in FIG. 3B). However, if the individual microphones ($M_1$, $M_2$) are not perfectly omni-directional, there will be a mismatch to the rear direction. This mismatch to the rear direction can be estimated by the Mic matching block. If the signal $I_1$ is mismatched by a factor 'mm' for sounds from the back, the transfer function difference between $ID_1$ and $ID_2$ for sounds from the back becomes $(1-mm*z^{-d})/(1+mm*z^{-d})$. To compensate this we apply the inverse transfer function which is $(mm+z^{-d})/(mm-z^{-d})$. After this compensation, the signals $IDE_1$ and $IDE_2$ are phase (and amplitude) equalized for signals from the rear direction.

The phase error introduced by the beamformer is compensated by applying the inverse transfer function. The geometrical configuration is taken into account by the delay d, the sum and difference operations in the beamformers are compensated by the corresponding sums/differences in the inverse transfer function. The mismatch mm is also included and compensated in the inverse transfer function.

Based on the current input unit configuration (signal IUconf) and the currently chosen configuration of beamformers (signal BFcont), the control unit generates control input EQcont for setting parameters of the equalizer unit (determining a transfer function of the EQU unit that inverses the phase changes applied to the sound input by the input unit (IU) and the directional unit (DIR), in other words to implement a currently relevant phase correction for application to the beamformed signals $ID_n$ to provide phase equalized beamformed signals $IDE_n$). The same inverse transfer function as explained above applies here. All compensations are preferably applied at the same time.

The beamformer output unit (BOU) determines the resulting beamformed signal (RFBS) from the equalized input signals according to a predefined rule or criterion. This information is embodied in control signal RBFcont, which is fed from the control unit (CONT) to the beamformer output unit (BOU). A predefined rule or criterion can in general be to optimize a property of the resulting beamformed output signal. More specifically, a predefined rule or criterion can e.g. be to minimize the energy of the resulting beamformed output signal (RBFS) (or to minimize the magnitude). A predefined rule or criterion may e.g. comprise minimizing amplitude fluctuations of the resulting beamformed output signal. Other rules or criteria may be implemented to provide a specific resulting beamformed output signal for a given application or sound environment. Other rules may be implemented, that are partly or completely independent of the resulting beamformed signal, e.g. put a static beamformer null towards a specified direction or sweep the beamformer null over a predefined range of angles.

Figure 6A:
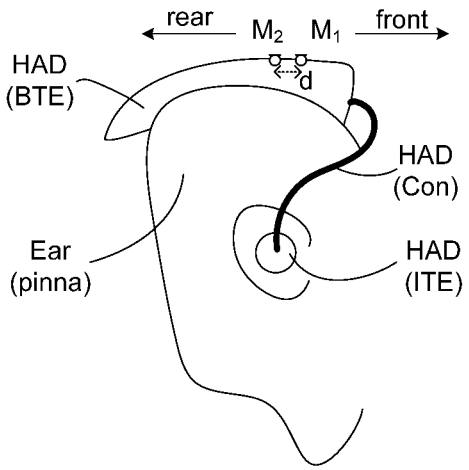
FIGS. 6A-6B illustrate a definition of the terms front and rear relative to a user of a hearing device, FIG. 6A showing an ear and a hearing device and the location of the front and rear microphones, and FIG. 6B showing a user's head wearing left and right hearing devices at left and right ears.
Figure 6B:
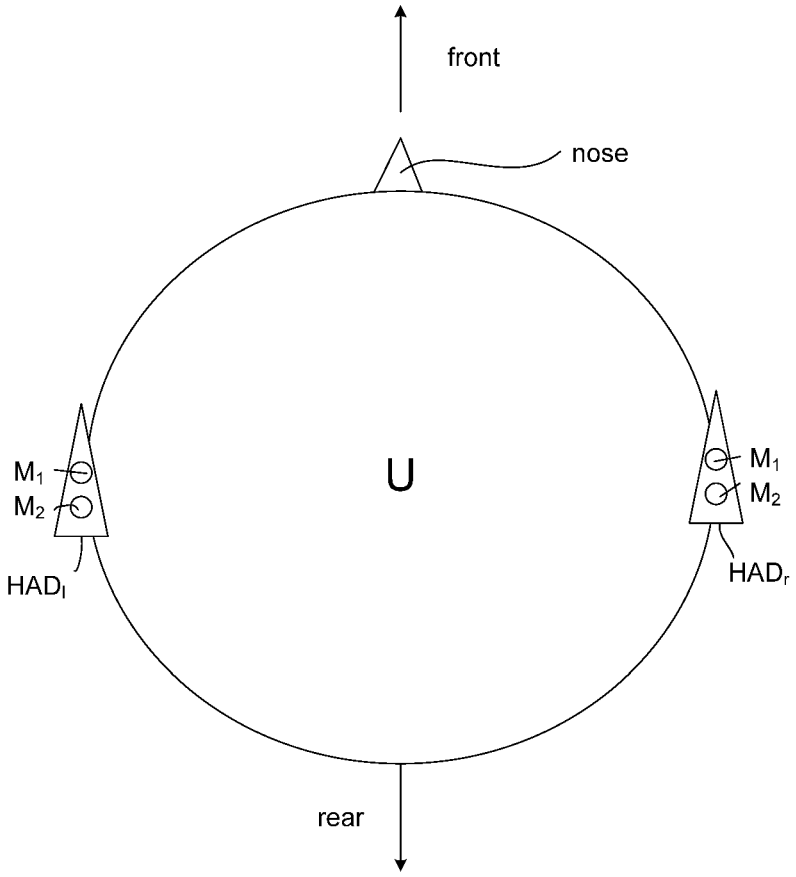

FIG. 3B illustrates the embodiment of a hearing device as shown in FIG. 2B in more detail. The first and second input transducers ($M_1$, $M_2$ in FIG. 2B) are denoted Front and Rear (omni-directional) microphones (the Front microphone being e.g. located in front of the Rear microphone on a (BTE-)part of a hearing device, when the (BTE-)part is worn, the BTE-part being adapted to be worn behind an ear of a user, front and rear being defined with respect to a direction indicated by the user's nose. This definition is illustrated in FIGS. 6A-6B. As an alternative to this assumption of the signal source of interest to the user being located in front of the user, other fixed directions may be assumed, e.g. to the right or left of the user (e.g. in a situation where the user is driving in a car at a front seat). Further alternatively, the location of the currently 'interesting' sound signal source may be dynamically determined.

The input unit (IU) of FIG. 3B comprises section
Microphone configuration comprising sub-sections
  Microphone synchronization,
  Mic matching,
The beamformer filter (BF) of FIG. 3B comprises sections
Directional signal creation (DIR),
Equalization (EQU) (phase and amplitude correction), and
Adaptive algorithm (BOU).

The directional microphone system comprising a microphone array and a directional algorithm, e.g. microphones $M_1$, $M_2$ and directional unit DIR of the embodiment of FIG. 2B is in FIG. 3B embodied in the sections denoted Microphone synchronization, Mic matching, and Directional signal creation (DIR), respectively. The Microphone synchronization section comprises first (Front) and second (Rear) omni-directional microphones providing electric input signals ($Im_1$, $Im_2$). The Microphone synchronization section further comprises a delay unit (Delay) for introducing a delay in one of the microphone paths (here in the path of the Front microphone) to provide that one microphone signal ($Im_1$) is delayed (providing delayed Front signal $Im_1d$) relative to the other ($I_2$, e.g. to compensate for a difference in propagation delay of the acoustic signal corresponding to the physical distance d (e.g. 10 mm) between the Front and the Rear microphones, i.e. to compensate for a geometrical configuration of the array). The Mic matching section comprises a microphone matching unit (Mic matching) for matching the Front and the Rear microphones (ideally to equalize their angle and frequency dependent gain characteristics/transfer functions). The Mic matching block ideally matches the amplitude (gain characteristics) only for signals from the look direction. The reason is that signals from the look direction are (ideally) cancelled in the target cancelling beamformer. The better the amplitude match for the look direction, the better the cancelling. In an embodiment, the Mic matching block detects the absolute level of the two microphone signals ($I_1d$, $I_2$) and attenuates the stronger of the two microphone signals and provides respective matched microphone signals ($IM_1$, $IM_2$). This is only one possible way to match the signals. In another embodiment, gain/attenuation is applied on only one of the two signals (always the same). In still another embodiment, the Mic matching block is configured to compensate the mismatch by keeping the amplitude of the sum signal ($ID_1$) constant. The Mic matching section (output of input unit IU) provides electric input signals ($I_1$, $I_2$) to the beamformer filter (BF). The Microphone synchronization and Mic matching sections together represent the Microphone configuration of the hearing device (and constitute in this embodiment input unit IU). The Directional signal creation section receives matched microphone signals ($I_1$, $I_2$) as input signals and provides directional (e.g. including omni-directional) signals ($ID_1$, $ID_2$) as output signals. In the Directional signal creation section, the delayed and microphone matched signal of the Front microphone path (signal $I_1$) is subtracted from the microphone matched signal of the Rear microphone path (signal $I_2$) in sum unit '+' (denoted Rear Cardioid) of the lower branch to provide directional signal $ID_2$ representing a rear cardioid signal. Further, the microphone matched signal of the Rear microphone path (signal $I_2$) is added to the delayed and microphone matched signal of the Front microphone path (signal $I_1$) in sum unit '+' (here denoted Double Omni (cf. Enhanced omni-directional)) of the upper branch to provide directional signal $ID_1$ representing an 'enhanced omni-directional' signal.

The equalization unit (EQU) of the embodiment of FIG. 2 is in FIG. 3B embodied in the section denoted Equalization (EQU), having directional (e.g. omni-directional) signals ($ID_1$, $ID_2$) as input signals and providing equalized signals ($IDE_1$, $IDE_2$) as output signals. The aim is to provide two directional signals ($IDE_1$, $IDE_2$) that have exactly (or substantially) the same phase over all frequencies (for signals from one specific direction that is not the look direction, e.g. the rear direction of from 90°, etc.).

The DoubleOmni signal ($ID_1$) is the sum of the two matched microphone signals ($I_1$, $I_2$) and the RearCardioid signal ($ID_2$) is the difference between the two matched microphone signals ($I_1$, $I_2$). The phase compensation of the sum operation ($I_2+I_1$) for the DoubleOmni signal ($ID_1$) is included in the $ID_2$ path (cf. Amplitude Correction below). Signal $ID_1$ is passed to the amplitude correction unit (cf. below). The differentiator operation ($I_2-I_1$) for the RearCardioid signal is compensated by an integrator operation. Using the Z-Transform, this can be formulated as follows:

The Differentiator can be represented as $1-z^{-1}$, the integrator is therefore $1/1-z^{-1}$.

The summation ($I_2+I_1$) in the DoubleOmni signal can be represented as $1+z^{-1}$ but to keep the DoubleOmni signal ($ID_1$) as natural as possible, this is not compensated. To equalize the phase between the DoubleOmni and RearCardioid signals, the same summation is applied on the RearCardioid signal ($1+z^{-1}$).

The complete transfer function for the RearCardioid signal is provided by the combination of the two mentioned transfer functions: $1+z^{-1}/(1-0.998*z^{-1})$ (optionally $(1+mm^{-1}*z^{-1})/(1-mm^{-1}*z^{-1})$ to compensate for a possible microphone mismatch, cf. above). This corresponds exactly to the RearCardioid equalization filter in the block diagram of FIG. 3B. The 0.998 factor is used to provide a stable filter. The output of the second (rightmost) sum unit '+' in the lower branch of the equalization unit (EQU) is passed as equalized signal $IDx_2$ to the amplitude correction unit (cf. Amplitude Correction below).

Note that, in principle, these calculations are only true for a signal coming from one specific direction that generates a signal delay of exactly 1 sample between the front and rear microphone signals. That's also the direction where the signals are perfectly subtracted. However, assuming that we have perfect omni-directional signals, it can be shown, that no matter what the signal delay d is in the formula $(1+z^{-d})/(1-z^{-d})$, the resulting phase difference introduced by this transfer function is always 90° (or $\pi/2$) over all frequencies. In other words, for perfect omni-directional signals, the required phase compensation does not depend on the array size or the direction of the incoming signal. Changing the delay d will however have a frequency dependent influence on the amplitude response.

In the equalization unit (EQU), the amplitude of the DoubleOmni signal ($ID_1$) is equalized to the amplitude of the input signal ($ID_2$) by multiplication with a factor of 0.5 (unit '½' in Amplitude Correction unit in FIG. 3B) thereby providing the (first) phase and amplitude equalized Omni-Directional signal $IDE_1$. This correction of the amplitude of the DoubleOmni signal ($ID_1$) might as well form part of the DIR-block (in which case no equalization of the DoubleOmni signal ($ID_1$) would be performed by the equalization unit (EQU)). A corresponding correction (multiplication with a factor of 0.5) of the RearCardioid signal ($ID_2$) might also form part of the DIR-block (in which case this part of the amplitude correction would not be performed in the equalization unit (EQU)). The (phase) equalized RearCardioid signal ($IDx_2$) is also equalized in amplitude (cf. unit Amplitude Correction in FIG. 3B) thereby providing the (second) phase and amplitude equalized RearCardioid signal $IDE_2$. A part of the amplitude equalization is performed elsewhere in the EQU (and/or in the DIR and/or in the Mic Matching unit) block. E.g. the integrator that is part of the EQU block will also amplify the low frequencies. However, this part of the EQU block only equalizes the amplitude for signals with exactly 1 sample delay.

The amplitude equalization for a signal that has a specific delay d is simply given by the quotient of the two transfer functions (one with delay 1 and one with delay d):

$$\text{Amplitude correction}=[(1+z^{-d})/(1-z^{-d})]/[(1+z^{-1})/(1-z^{-1})].$$

For perfect omni-directional microphones, it can be shown that this expression is purely real (no phase shift) and can be simplified to:

$$\text{Amplitude correction}=\tan(\text{pi}*f)/\tan(\text{pi}*f*d),$$

where f is the normalized frequency and d is the delay. Note that this corresponds to a frequency dependent gain correction.

The adaptive filter (AF) and subtraction unit '+' of the embodiment of FIG. 2B is in FIG. 3B embodied in units denoted LMS and '+', respectively, in the Amplitude correction, adaptive algorithm (BOU) section. LMS is short for Least Mean Square and is a commonly used algorithm used in adaptive filters (other adaptive algorithms may be used, however, e.g. NLMS, RLS, etc.). If the LMS filter comprises more than one coefficient, a delay element (Del in FIG. 3B) is inserted into the upper signal path (delaying the signal IDE1 to match the delay introduced by the LMS block. The adaptive filter (denoted LMS in FIG. 3) and sum unit '+' subtracts a modified version $IDEm_2$ of the equalized RearCardioid signal $IDE_2$ from the equalized OmniDirectional (optionally delayed) signal $IDE_1$ to create a signal RBFS with the smallest possible energy. It reduces the energy by attenuating all signals except the signals coming from the front. The output signal RBFS represents a FrontCardioid signal determined by subtracting a modified (equalized in phase and amplitude) RearCardioid signal from the OmniDirectional signal (equalized in amplitude).

The task of the adaptive filter (LMS) (and the subtraction unit '+') is to minimize the expected value of the squared magnitude of the output signal RBFS ($E[ABS(RBFS)^2]$). According to this rule or criterion, it is for example an 'advantage' to attenuate (filter out) time frequency units (TFU, (k,m), where k, m are frequency and time indices, respectively) of the rear signal that have large magnitudes where the corresponding time frequency units of the front signal do not. This is beneficial, because if (TFU (front)=LOW, TFU(rear)=HIGH), it may be concluded that the signal content of the rear signal is noise. Otherwise—i.e. if not filtered out—these contributions from the rear signal would increase the $E[ABS(RBFS)^2]$.

Figure 4:
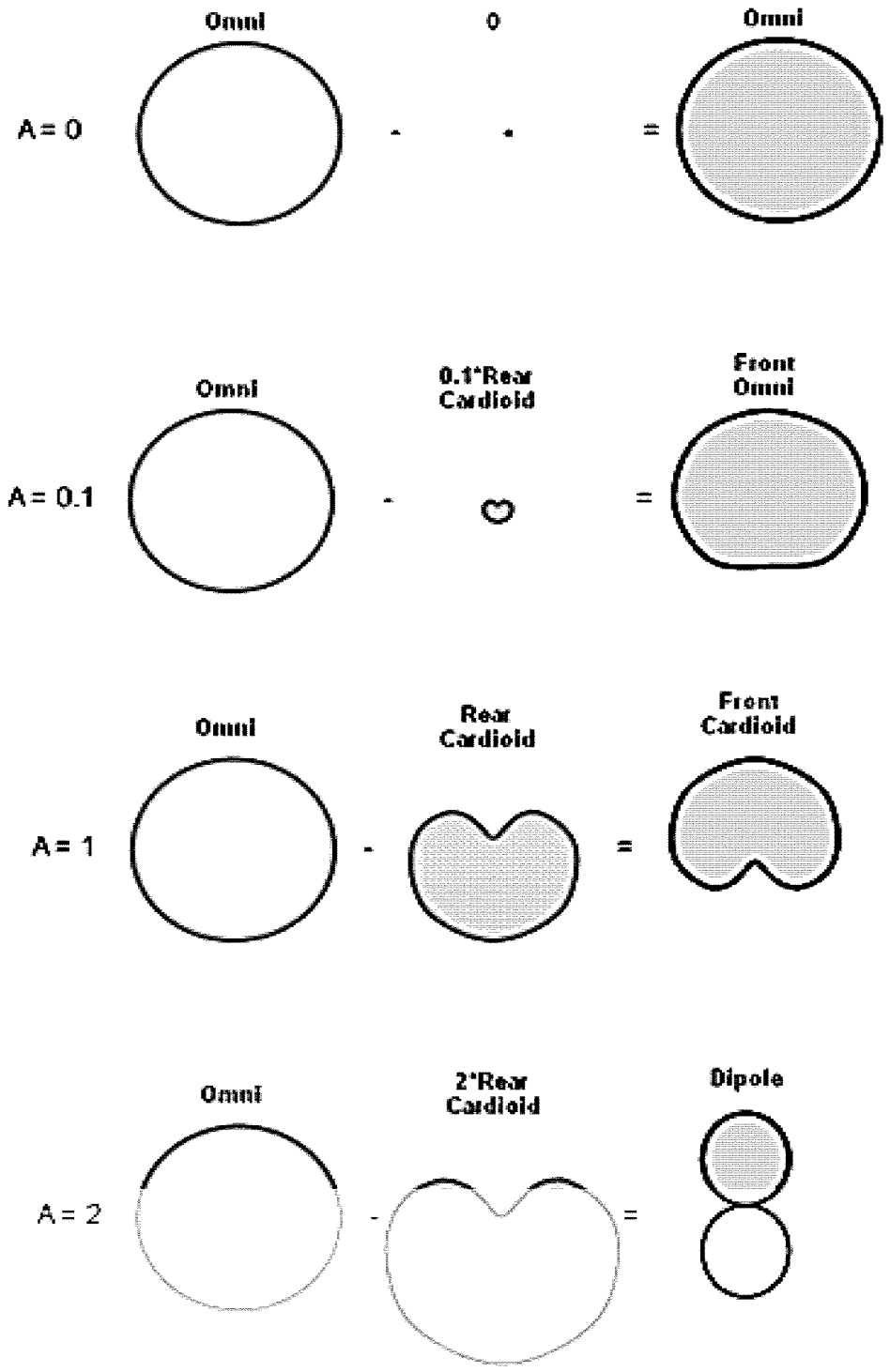
FIG. 4 shows a schematic visualization of the functionality of an embodiment of a beamforming algorithm according to the present disclosure.

FIG. 4 shows a schematic visualization of the functionality of an embodiment of a beamforming algorithm according to the present disclosure (as exemplified in FIG. 3B). The individual plots of FIG. 4 illustrate the angle dependent gain or attenuation of the signal in question (front and rear directions being represented in the plots as vertical up and vertical down directions, and to correspond to the definition outlined in FIG. 6B). A circular plot indicates an equal gain or attenuation irrespective of the angle (termed 'omni-directional'). The algorithm preferably fades to the configuration with the lowest level by keeping the front response unchanged. It can fade from 'Enhanced Omni' (termed Omni in top part of FIG. 4) to Dipole directionality (termed Dipole in lower part of FIG. 4) over a number of intermediate directional characteristics (in FIG. 4, two are shown, termed Front Omni, Front Cardioid), or vice versa (from Dipole to Enhanced Omni). In very quiet situations or if wind noise is present, it will immediately fade to Enhanced Omni. If there is a lot of noise in the rear direction, it will fade to the best possible directionality mode, depending on the surrounding noise. At the same time, the system transfer function to the front direction is not changed, when fading from Enhanced Omni to one of the 'true' directional modes, meaning that there is no LF roll off. An advantage thereof is that the proposed solution makes the fading almost inaudible and offers sufficient loudness even in directional mode. Further, the choice of the correct directionality doesn't depend on a classification system as usual, but on a simple first order LMS algorithm, which will always find the best possible solution.

In the illustration of FIG. 4, the adaptive algorithm (LMS, cf. FIG. 3B) is very simple and implements the following formula: RBFS=Output=Omni−A*RearCardioid. A is a scalar factor and varies between 0 and 2 for example. In an embodiment, A is a complex constant. In an embodiment, A is defined for each frequency band ($A_i$, i=1, 2, . . . , $N_{FB}$, where $N_{FB}$ is the number of frequency bands). FIG. 4 schematically shows four situations corresponding to four different values of A (from top to bottom): A=0, A=0.1, A=1, A=2. For each value of A, the two input signals (Omni (=$IDE_1$ in FIG. 3B) and A*RearCardioid (=A*$IDE_2$ in FIG. 3B)) and the resulting signal (Output (=RBFS in FIG. 3B)) are schematically shown. It is seen that the resulting Output changes from an omni-directional signal (Omni) for A=0 (by increasing the value of A) to a dipole signal (Dipole) for A=2. The intermediate values represented in FIG. 4, A=0.1 and A=1 result in a light front dominated omni-directional signal (FrontOmni) and a front cardioid signal (FrontCardioid), respectively.

The LMS is adapting the factor A so that the output Energy ($E[ABS(Output)^2]$) is as small as possible. Normally, this means that the Null in the output polar plot is directed to the loudest noise source. An advantage of the present algorithm is that it allows a fading to Omni mode to reduce specific directional noise (e.g. wind noise).

FIG. 5 shows an exemplary application scenario of an embodiment of a hearing assistance system according to the present disclosure.

Figure 5A:
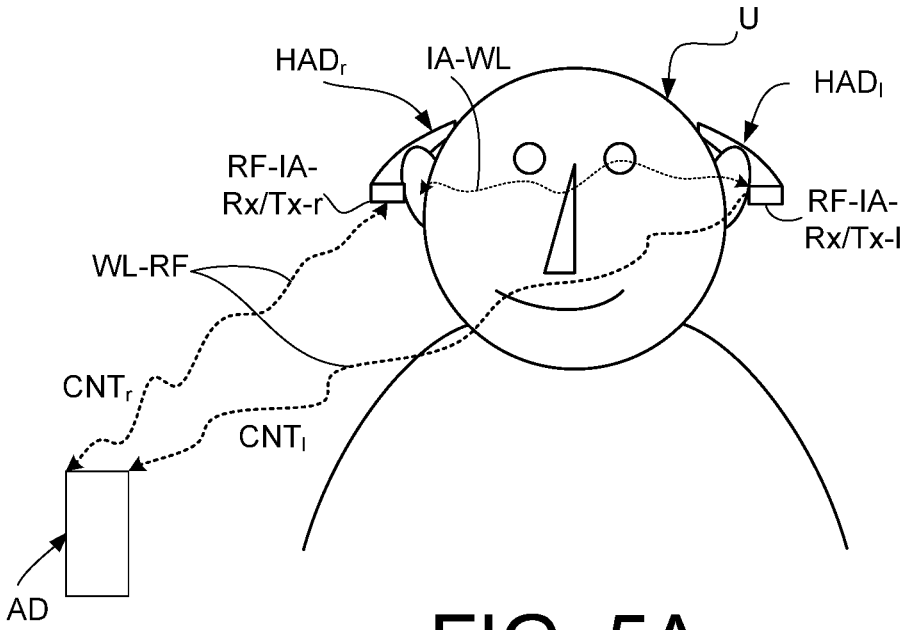
FIG. 5 shows an exemplary application scenario of an embodiment of a hearing assistance system according to the present disclosure, FIG. 5A illustrating a user, a binaural hearing aid system and an auxiliary device comprising a user interface for the system, and FIG. 5B illustrating the auxiliary device running an APP for initialization of the directional system.
Figure 5B:
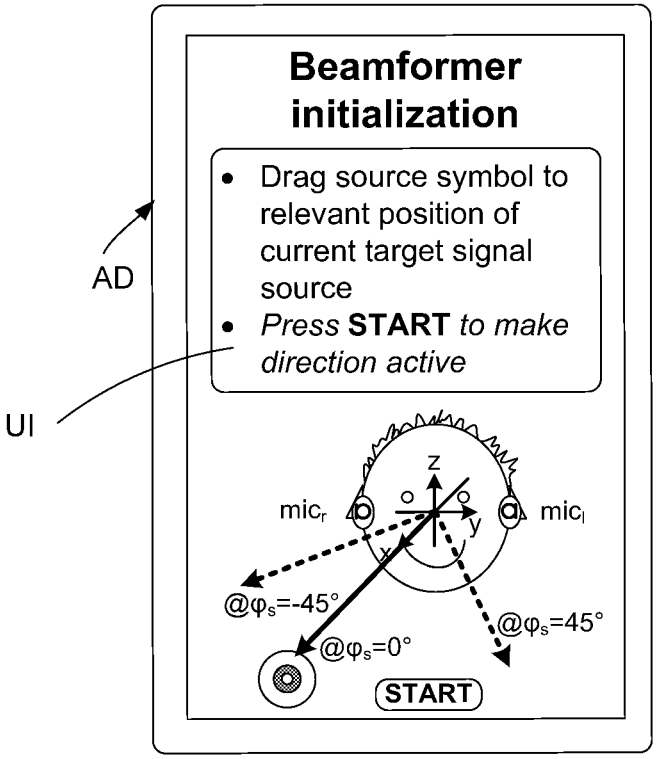

FIG. 5A shows an embodiment of a binaural assistance system, e.g. a binaural hearing aid system, comprising left (second) and right (first) hearing devices ($HAD_l$, $HAD_r$) in communication with a portable (handheld) auxiliary device (AD) functioning as a user interface (UI) for the binaural hearing aid system. In an embodiment, the binaural hearing aid system comprises the auxiliary device AD (and the user interface UI). The user interface UI of the auxiliary device AD is shown in FIG. 5B. The user interface comprises a display (e.g. a touch sensitive display) displaying a user of the hearing assistance system and a number of predefined locations of the target sound source relative to the user. Via the display of the user interface (under the heading Beamformer initialization), the user U is instructed to:

- Drag source symbol to relevant position of current target signal source.
- Press START to make the chosen direction active (in the beamforming filter).
- These instructions should prompt the user to
- Locate the source symbol in a direction relative to the user where the target sound source is expected to be located (e.g. in front of the user ($\phi_s$=0°), or at an angle different from the front, e.g. $\phi_s$=−45° or $\phi_s$=+45°)).
- Press START to initiate the use of the chosen direction as the 'look direction' of a target aiming beamformer.

Hence, the user is encouraged to choose a location for a current target sound source by dragging a sound source symbol (circular icon with a grey shaded inner ring) to its approximate location relative to the user (e.g. if deviating from a front direction, where the front direction is assumed as default). The 'Beamformer initialization' is e.g. implemented as an APP of the auxiliary device AD (e.g. a SmartPhone). Preferably, when the procedure is initiated (by pressing START), the chosen location (e.g. angle and possibly distance to the user), are communicated to the left and right hearing devices for use in choosing an appropriate corresponding (possibly predetermined) set of filter weights, or for calculating such weights. In the embodiment of FIG. 5, the auxiliary device AD comprising the user interface UI is adapted for being held in a hand of a user (U), and hence convenient for displaying a current location of a target sound source.

In an embodiment, communication between the hearing device and the auxiliary device is in the base band (audio frequency range, e.g. between 0 and 20 kHz). Preferably however, communication between the hearing device and the auxiliary device is based on some sort of modulation at frequencies above 100 kHz. Preferably, frequencies used to establish a communication link between the hearing device and the auxiliary device is below 70 GHz, e.g. located in a range from 50 MHz to 70 GHz, e.g. above 300 MHz, e.g. in an ISM range above 300 MHz, e.g. in the 900 MHz range or in the 2.4 GHz range or in the 5.8 GHz range or in the 60 GHz range (ISM=Industrial, Scientific and Medical, such standardized ranges being e.g. defined by the International Telecommunication Union, ITU). In an embodiment, the wireless link is based on a standardized or proprietary technology. In an embodiment, the wireless link is based on Bluetooth technology (e.g. Bluetooth Low-Energy technology) or a related technology.

In the embodiment of FIG. 5A, wireless links denoted IA-WL (e.g. an inductive link between the left and right assistance devices) and WL-RF (e.g. RF-links (e.g. Bluetooth) between the auxiliary device AD and the left $HAD_l$, and between the auxiliary device AD and the right $HAD_r$, hearing device, respectively) are indicated (and implemented in the devices by corresponding antenna and transceiver circuitry, indicated in FIG. 5A in the left and right hearing devices as RF-IA-Rx/Tx-I and RF-IA-Rx/Tx-r, respectively).

In an embodiment, the auxiliary device AD is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for allowing the selection an appropriate one of the received audio signals (and/or a combination of signals) for transmission to the hearing device(s). In an embodiment, the auxiliary device is or comprises a remote control for controlling functionality and operation of the hearing device(s). In an embodiment, the auxiliary device AD is or comprises a cellular telephone, e.g. a SmartPhone, or similar device. In an embodiment, the function of a remote control is implemented in a SmartPhone, the SmartPhone possibly running an APP allowing to control the functionality of the audio processing device via the SmartPhone (the hearing device(s) comprising an appropriate wireless interface to the SmartPhone, e.g. based on Bluetooth (e.g. Bluetooth Low Energy) or some other standardized or proprietary scheme).

In the present context, a SmartPhone, may comprise

- a (A) cellular telephone comprising a microphone, a speaker, and a (wireless) interface to the public switched telephone network (PSTN) COMBINED with
- a (B) personal computer comprising a processor, a memory, an operative system (OS), a user interface (e.g. a keyboard and display, e.g. integrated in a touch sensitive display) and a wireless data interface (including a Web-browser), allowing a user to download and execute application programs (APPs) implementing specific functional features (e.g. displaying information retrieved from the Internet, remotely controlling another device, combining information from various sensors of the smartphone (e.g. camera, scanner, GPS, microphone, etc.) and/or external sensors to provide special features, etc.).

FIGS. 6A-6B illustrate a possible definition of the terms front (front) and rear (rear) relative to a user (U) of a hearing device (HAD). FIG. 6A shows an ear (ear (pinna)) and a hearing device (HAD) operationally mounted at the ear of the user. The hearing device (HAD) comprises a BTE part (HAD (BTE)) adapted for being located behind an ear of the user, an ITE part (HAD (ITE)) adapted for being located in an ear canal of the use, and a connecting element (HAD (Con)) for electrically and/or mechanically and/or acoustically connecting the BTE and ITE parts. The location of the front and rear microphones ($M_1$, and $M_2$ respectively) on the BTE part (HAD (BTE)) of the hearing device are indicated together with arrows indicating front and rear directions relative to the user. and FIG. 6B showing a user's head wearing left and right hearing devices at left and right ears. Other definitions of preferred directions may be used. Likewise, other configurations (partitions) of hearing devices may be used. Further, other types of hearing devices, e.g. comprising vibrational stimulation of the user's skull or electrical stimulation of the user's cochlear nerve, may be used.

The invention is defined by the features of the independent claim(s). Preferred embodiments are defined in the dependent claims. Any reference numerals in the claims are intended to be non-limiting for their scope.

Some preferred embodiments have been shown in the foregoing, but it should be stressed that the invention is not limited to these, but may be embodied in other ways within the subject-matter defined in the following claims and equivalents thereof.

REFERENCES

[Griffiths and Jim; 1981] L. J. Griffith, C. W. Jim, An Alternative Approach to Linearly Constrained Adaptive Beamforming, IEEE Transactions on Antennas and Propagation, Vol. AP-30, No. 1, January 1982, pp. 27-34.

[Schaub; 2008] Arthur Schaub, Digital hearing Aids, Thieme Medical. Pub., 2008.

[Gooch; 1982] Richard P. Gooch, Adaptive Pole-Zero array processing, Proc. 16Th Asilomar Conf. Circuits Syst. Comput., pp. 45-49, November 1982.

[Joho and Moschytz; 1998] Marcel Joho, George S. Moschytz, On the design of the target-signal filter in adaptive beamforming, ISCAS '98. Proceedings of the 1998 IEEE International Symposium on Circuits and Systems, Vol. 5, pp. 166-169, 1998.

The invention claimed is:

1. A hearing device comprising an input that provides first and second electric input signals ($I_1$, $I_2$) representing sound signals, and a beamformer filter that frequency-dependent directionally filters the electric input signals, and outputs a resulting beamformed output signal, the beamformer filter comprising a directional filter that provides respective first and second beamformed signals from weighted combinations of the electric input signals, wherein the first and second beamformed signals are an omni-directional signal and a directional signal with a maximum gain in a rear direction, respectively, a rear direction being defined relative to a target sound source, an equalizer that equalizes a phase of at least one of the beamformed signals and provides at least first and/or second equalized beamformed signals, and a beamformer output that provides the resulting beamformed output signal from the first and second equalized beamformed signals, wherein the equalizer is configured to compensate the beamformed signals for phase differences imposed by the directional filter, the beamformer output comprises an adaptive filter configured to filter the second equalized beamformed signal and to provide a modified second equalized beamformed signal, and a subtraction unit for subtracting the modified second equalized beamformed signal from the first equalized beamformed signal thereby providing the resulting beamformed output signal, and the adaptive filter is configured to provide the resulting beamformed output signal in accordance with a predefined rule or criterion.

2. A hearing device according to claim 1 wherein the equalizer is configured to compensate the beamformed signals for phase differences imposed by the input unit.

3. A hearing device according to claim 1 wherein the beamformer output is configured to optimize a property of the resulting beamformed output signal.

4. A hearing device according to claim 1 wherein the beamformer output is configured to provide the resulting beamformed output signal in accordance with a predefined rule or criterion.

5. A hearing device according to claim 4 wherein the predefined rule or criterion comprises minimizing the energy, amplitude or amplitude fluctuations of the resulting beamformed output signal.

6. A hearing device according to claim 1 wherein the adaptive filter is configured to use a first order LMS or NLMS algorithm to fade between an omni-directional and a directional mode.

7. A hearing device according to claim 1 wherein the first beamformed signal is an enhanced omni-directional signal created by adding said first and second electric input signals.

8. A hearing device according to claim 1 wherein the first beamformed signal is an enhanced omni-directional signal created by a delay and sum beamformer, the enhanced omni-directional signal being substantially omni-directional at relatively low frequencies and slightly directional at relatively high frequencies.

9. A hearing device according to claim 1 comprising a TF-conversion unit for providing a time-frequency representation of a time-variant input signals.

10. A hearing device according to claim 1 wherein said input provides more than two electric input signals.

11. A hearing device according to claim 1 wherein the equalizer is configured to compensate the beamformed signals for phase and amplitude differences imposed by the input unit and/or the directional unit.

12. A hearing device according to claim 1 wherein the equalization is only performed on the second beamformed signal.

13. A hearing device according to claim 1 comprising a hearing aid, a headset, an active ear protection system, or combinations thereof.

14. A hearing device according to claim 1, wherein the predefined rule or criterion comprises minimizing the signal from one specific direction.

15. A hearing device according to claim 1, wherein the predefined rule or criterion comprises sweeping a zero of the angle dependent characteristics of the resulting beamformed output signal over predefined angles or over a predefined range of angles.

16. A method of operating a hearing device comprising first and second input transducers for converting an input sound to respective first and second electric input signals, a beamformer filter for frequency-dependent directionally filtering the electric input signals, and outputting a resulting beamformed output signal, the method comprising:

directionally filtering to provide respective first and second beamformed signals from weighted combinations of said electric input signals wherein the first and second beamformed signals are an omni-directional signal and a directional signal with a maximum gain in a rear direction, respectively, a rear direction being defined relative to a target sound source;

equalizing a phase of at least one of said beamformed signals and providing a first and second equalized beamformed signals;

adaptive filtering the second equalized beamformed signal and providing a modified second equalized beamformed signal;

subtracting the modified second equalized beamformed signal from the first equalized beamformed signal thereby providing a resulting beamformed output signal; and providing the resulting beamformed output signal in accordance with a predefined rule or criterion, wherein the beamformed signals are compensated for phase differences imposed by the directional filtering.

17. A data processing system comprising:

a processor; and memory having stored thereon program code that when executed causes the processor to perform the method of claim 16.

* * * * *